US007665625B1

(12) United States Patent
Rothstein et al.

(10) Patent No.: US 7,665,625 B1
(45) Date of Patent: Feb. 23, 2010

(54) CONTAINER AND CLOSURE

(75) Inventors: James L. Rothstein, 151 Fisher Rd., Mahwah, NJ (US) 07430; Robert Z. Rothstein, 130 Mount Auburn St., Unit # 212, Cambridge, MA (US) 02138; Daniel J. Lewis, Ridgewood, NJ (US); William A. Jaremko, Allendale, NJ (US)

(73) Assignees: James L. Rothstein, Mahwah, NJ (US); Robert Z. Rothstein, Cambridge, MA (US)

( * ) Notice: Subject to any disclaimer, the term of this patent is extended or adjusted under 35 U.S.C. 154(b) by 805 days.

(21) Appl. No.: 11/439,675

(22) Filed: May 24, 2006

Related U.S. Application Data

(60) Provisional application No. 60/684,705, filed on May 26, 2005.

(51) Int. Cl.
*B65D 45/16* (2006.01)

(52) U.S. Cl. ..... 220/326; 220/4.23; 220/4.22; 220/263; 220/264; 220/520

(58) Field of Classification Search ..... 220/529, 220/520, 262, 263, 264, 324, 4.22, 4.23, 220/326, 835, 608
See application file for complete search history.

(56) References Cited

U.S. PATENT DOCUMENTS

| | | | | | |
|---|---|---|---|---|---|
| 1,358,540 | A | | 11/1920 | Goodwin | |
| 2,181,150 | A | * | 11/1939 | Pittenger | 220/265 |
| 2,251,138 | A | | 7/1941 | Knight | |
| 2,258,306 | A | * | 10/1941 | Trollen | 281/45 |
| 2,797,015 | A | | 6/1957 | Grosz | |
| 2,873,876 | A | * | 2/1959 | Reitzel | 220/326 |
| 3,286,829 | A | | 11/1966 | Lyman | |
| 3,485,434 | A | * | 12/1969 | Donovan et al. | 229/406 |
| 3,709,538 | A | | 1/1973 | Seitz | |
| 3,825,110 | A | * | 7/1974 | Halbich et al. | 206/6 |
| RE30,882 | E | | 3/1982 | Leavelle | |
| 4,363,403 | A | * | 12/1982 | Raucci et al. | 206/387.13 |
| 4,392,503 | A | * | 7/1983 | Watanabe | 132/301 |
| 4,648,511 | A | * | 3/1987 | Ritman | 206/541 |
| 4,696,317 | A | * | 9/1987 | Shioi et al. | 132/314 |
| 4,948,303 | A | | 8/1990 | Good | |
| 5,035,319 | A | * | 7/1991 | Kunisch | 206/6.1 |
| 5,050,623 | A | * | 9/1991 | Yuhara et al. | 132/301 |
| 5,082,114 | A | * | 1/1992 | Bunin | 206/539 |

(Continued)

*Primary Examiner*—Anthony Stashick
*Assistant Examiner*—Christopher B McKinley
(74) *Attorney, Agent, or Firm*—W. Patrick Quast

(57) ABSTRACT

A molded container and closure latch mechanism include a top portion and bottom portion which are connected by a hinge which biases the top away from the bottom unless the latch mechanism is engaged. The latch mechanism is pivotally connected to the top. It engages a molded contoured segment on the bottom to secure the container in a closed position. Anomalies on the top surface of the latch mechanism provide a convenience to the user in locating pressure points for opening and closing the container. A separator can be used internal to the container to create two separate compartments. In one adaptation the interior surface can include raised protrusions which permit contents such as a soap bar to be raised off from the surface. Other modifications too the interior can be effected to accommodate a wide variety of products. The containers can be provided in a grouping with relative dimensions suitable to store a wide variety of personal effects.

14 Claims, 18 Drawing Sheets

U.S. PATENT DOCUMENTS 5,131,551 A * 7/1992 Wells ..... 220/4.23
5,131,558 A * 7/1992 Hiromori ..... 220/326
5,213,226 A * 5/1993 Nichols ..... 220/263
5,337,913 A * 8/1994 Fukuda ..... 220/326
5,351,818 A 10/1994 Daneshvar
5,353,946 A * 10/1994 Behrend ..... 220/326
5,526,953 A * 6/1996 Chieng ..... 220/4.23
5,575,399 A * 11/1996 Intini ..... 220/835
5,577,779 A * 11/1996 Dangel ..... 292/80
5,615,765 A * 4/1997 Roericht ..... 206/45.23
5,638,957 A * 6/1997 Brasier ..... 206/581
5,971,199 A * 10/1999 Jackson et al. ..... 220/608
6,026,950 A * 2/2000 Wisniewski ..... 206/6
6,131,760 A * 10/2000 Huang ..... 220/526
6,206,221 B1 * 3/2001 Bando et al. ..... 220/254.5
6,367,651 B2 * 4/2002 Laib et al. ..... 220/676
6,394,298 B1 * 5/2002 Zaidman ..... 220/259.1
6,659,272 B2 * 12/2003 Bellin et al. ..... 206/232
6,675,959 B1 * 1/2004 Chiang ..... 206/6
6,726,004 B2 * 4/2004 Watson ..... 206/6
6,796,422 B1 * 9/2004 Lu ..... 206/6
6,863,179 B2 * 3/2005 Leykin et al. ..... 206/565
6,926,135 B1 * 8/2005 Liebers ..... 206/6
7,090,074 B2 * 8/2006 Isaacs ..... 206/214
7,228,984 B2 * 6/2007 Tack et al. ..... 220/259.1
7,469,787 B2 * 12/2008 Yuhara ..... 206/581
2005/0051454 A1 3/2005 Coe
2005/0139598 A1 * 6/2005 Tack et al. ..... 220/259.1
2006/0096984 A1 * 5/2006 Bandoh et al. ..... 220/254.5
2007/0062964 A1 * 3/2007 Kampf et al. ..... 220/835

* cited by examiner

CONTAINER AND CLOSURE

This application claims the benefit of U.S. Provisional Application No. 60/684,705, filed May 26, 2005.

FIELD OF THE INVENTION

This invention relates to a one-piece container and closure including a specialized closure fastener which makes the container relatively easy to open and close, and a grouping of such containers having a similarly aesthetically pleasing and functionally advantageous shape.

BACKGROUND OF THE INVENTION

We are all constantly on the go. Whether it is to the office, or overnight or extended vacation, most of the time, one or more personal care items will also make the trip. We will be accompanied by one or more of the following: our eyeglasses, tooth brush, personal hygiene items, medicines, our own special soap, or the like, the assortment and quantity depending on the length of the trip away from home.

Various solutions exist. We may use a single pouch or overnight personal care kit into which we place the various personal items we plan to bring. This implies that our trip is at least overnight and obviously this type container is not appropriate for short, daytime trips from home. Further, individual items are oft times just placed in the carrying container with other personal care articles with minimal regard for the possible deleterious effect of one contacting another. Many times the carrying container is difficult to open or lacks a suitable closure fastener to keep it closed while in transit.

Various cases, containers and boxes have been developed that provide different solutions for the needs of the traveler. Representative examples are shown in the following United States Patents or published applications: 2005/0051454; U.S. Pat. Nos. 6,926,135; 6,726,004; 5,351,818; 5,082,114; 5,035,319; 4,948,303; 3,709,538; 3,286,829; 2,797,015; 2,251,138; 1,358,540; and, RE 30,882.

It is therefore a principal object to provide a container which is molded in its entirety except for the closure mechanism which is separately molded and installed on the container.

It is a further object to provide an integral container which includes a top and bottom portion and plastic hinge between the two, which are molded together in one continuous piece.

It is still another object to provide a hinge member which is dimensioned to provide an inherent bias for urging the top portion away from the bottom portion when the closure member is released from the closed position.

It is yet another object of the invention to provide a means for generating an audible click when the container is opened or closed.

Towards the accomplishment of these and other objects and advantages which will become more apparent after a consideration of the accompanying drawings and the following description, there is disclosed a molded container which comprises a top portion having a front and rear edge and a bottom portion having a front and rear edge. The front and rear edges are coextensive with each other when the container is in a closed position. The top and bottom portions are joined by a hinge portion of predetermined thickness. The hinge portion connects together at least a portion of the coextensive rear edges of the top and bottom portions. The top and bottom portions and the hinge portion are molded together from a predetermined type of plastic to form an integral one-piece unit. A latch mechanism includes an arcuately shaped molded latch member which has a rearward portion and a front portion and includes pivot means and a latch engagement portion as molded.

Each of the top and bottom portions have respective partially arcuately shaped sections beginning at their respective front edge and extending back towards their respective rear edge. Each of the top and bottom portions further includes a respective molded recess area formed in their respective partially arcuately shaped section. The molded recess areas extend from the front edge of the respective top and bottom portions back towards the respective rear edges.

The molded recess area of the top portion includes molded complementing pivot means for providing a pivotal connection when engaged by the pivot means of the latch member. The molded recess area of the bottom portion includes a molded contoured segment of predetermined design so as to engage the latch engagement portion of the latch member when the front edge of the top portion is brought contiguous to the front edge of the bottom portion and an operator applies pressure to a portion of the latch member disposed between the pivotal connection and the front edge.

The latch engagement portion is disengaged from the molded contoured segment when an operator applies pressure to a second portion of the latch member disposed between the pivotal connection and the rear edge of the top portion.

The latch member is dimensioned and contoured to nest in the molded recess area at assembly. The latch member includes a top surface which is contoured so as to provide a continuous smooth surface with the respective partially arcuately shaped section of the top portion.

The top surface of the latch member can include at least one surface anomaly which typically is a depression or a raised portion. This is disposed on the top surface between the pivotal connection and the rear edge of the top portion. The surface anomaly is intended to facilitate the locating of a point on the top surface in the blind, so that the operator can apply pressure to thereby disengage the latch engagement portion from the molded contoured segment.

The top surface of the latch member may include a second anomaly other than the one used to open the container, which is disposed on the top surface between the pivotal connection and the front edge of the top portion so as to facilitate the locating of a point on the top surface where the operator can apply pressure to engage the latch engagement portion and the molded contoured segment when it is desired to close the container.

The hinge portion is dimensioned and adapted to have an inherent bias such that when the latch engagement portion is disengaged from the molded contoured segment, the inherent bias moves the top portion away from the bottom portion.

For certain usages the bottom portion of the container can have an interior surface which is molded to include a plurality of raised portions interior to the bottom portion which are arranged and adapted so as to support any contents, for example, a soap bar, within the container off from the interior surface.

Still for other uses, a separator member will be pivotally connected to a portion of the interior surface of the container. The separator member functions to provide at least two separate compartments interior to the container. The separator member typically, as molded, includes pivoting means for pivotally connecting the separator member to one or the other of the top or bottom portions to form the two separate compartments. The separator member includes means for disengaging the separator member from one or the other of the top or bottom portions to thereby permit access to contents contained in the sealed-off compartment. The respective volume of at least one of the two compartments can be subdivided into a plurality of smaller volumes by a corresponding number of partition members.

The rearward portion of the latch member and the molded recess area of the top portion can include complementing segments juxtaposed to each other and configured so as to result in an audible click when there is relative movement between the two as the latch mechanism is engaged during the opening and closing operations.

The molded containers can have varying respective lengths, heights and widths to accommodate different contents.

The interior of the molded containers can be modified to accommodate any number of products which may be placed therein.

DESCRIPTION OF THE PREFERRED EMBODIMENT

Figure 1:
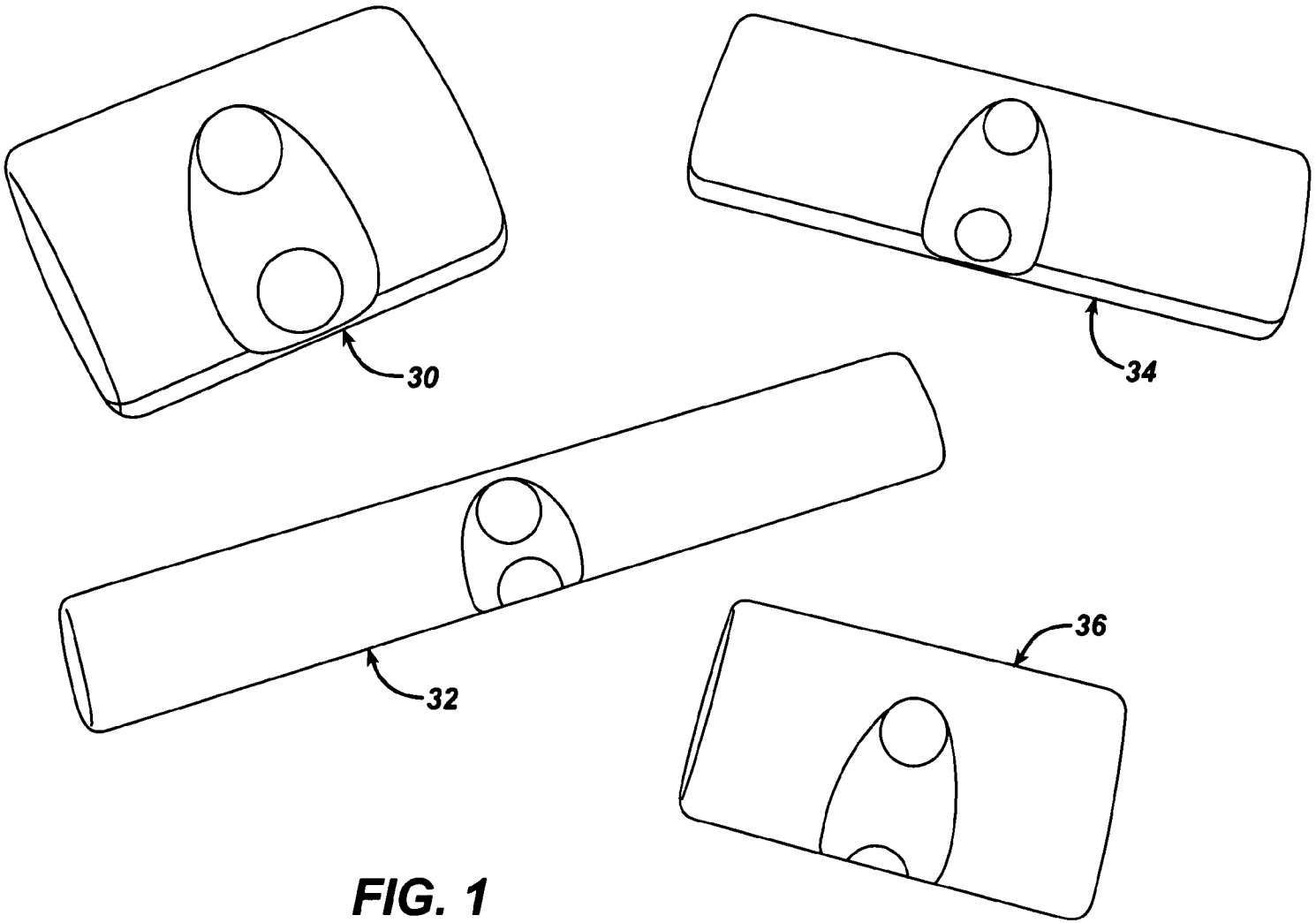
FIG. 1 is a perspective view of a grouping of containers as presently conceived, each of which embodies features of the present invention.

In the following description, on occasion, the same reference numerals have been used to refer to an identical container or elements thereof which may appear in the various figures throughout.

Referring to FIG. 1, four, presently conceived adaptations of the present invention are shown. These include a soap dish, 30, tooth brush holder, 32, a general, personal effects container, 34, and a pill or jewelry container, 36. Of course, the general principles of the present invention can find application with other type containers for personal accessories as a perceived need is identified. Certainly any one of the cases identified herein can be used to house a host of different type personal care items.

Figure 2:
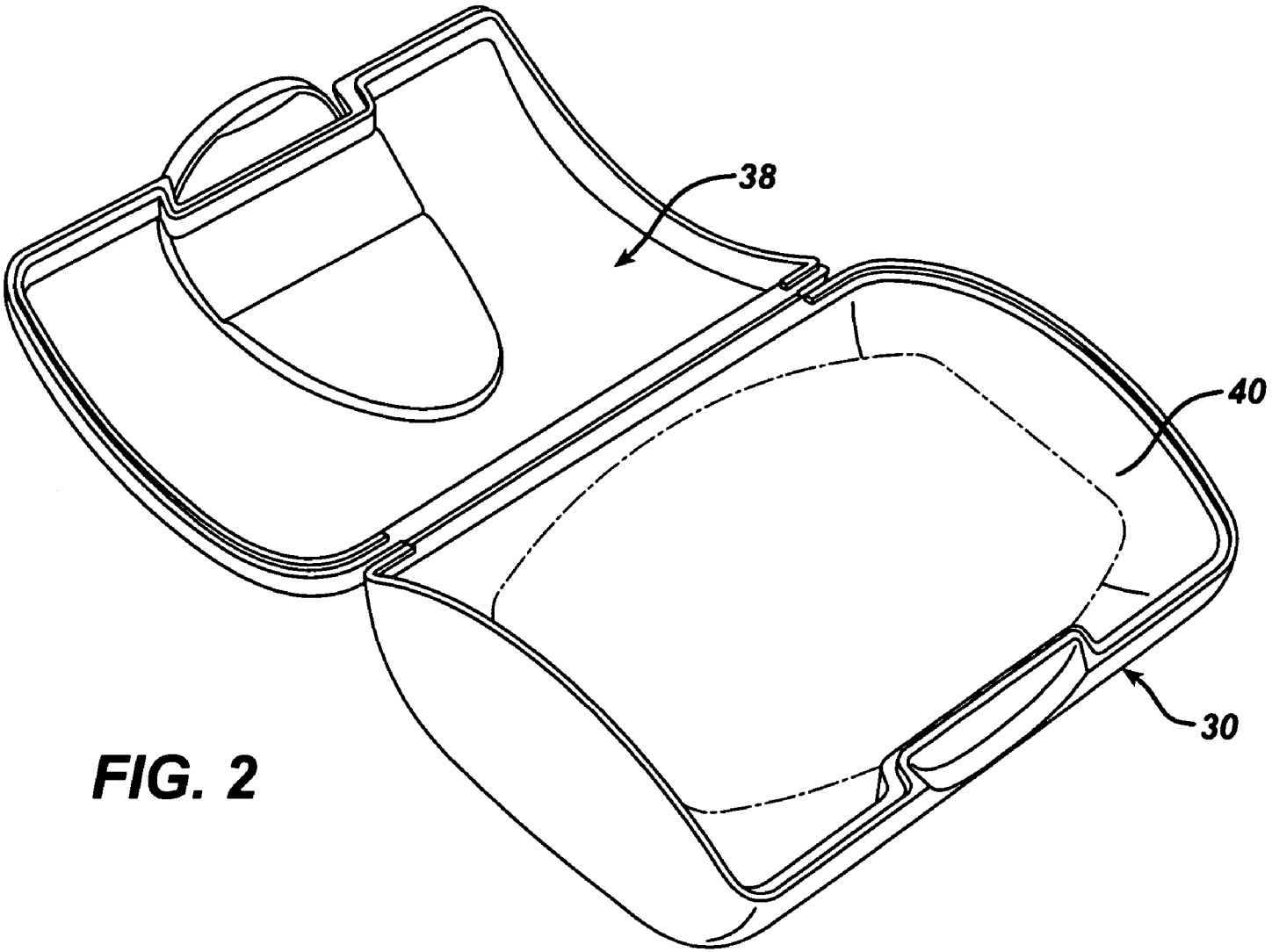
FIG. 2 is a perspective view of an open one of the containers in the grouping of FIG. 1, shown in its application.
Figure 3:
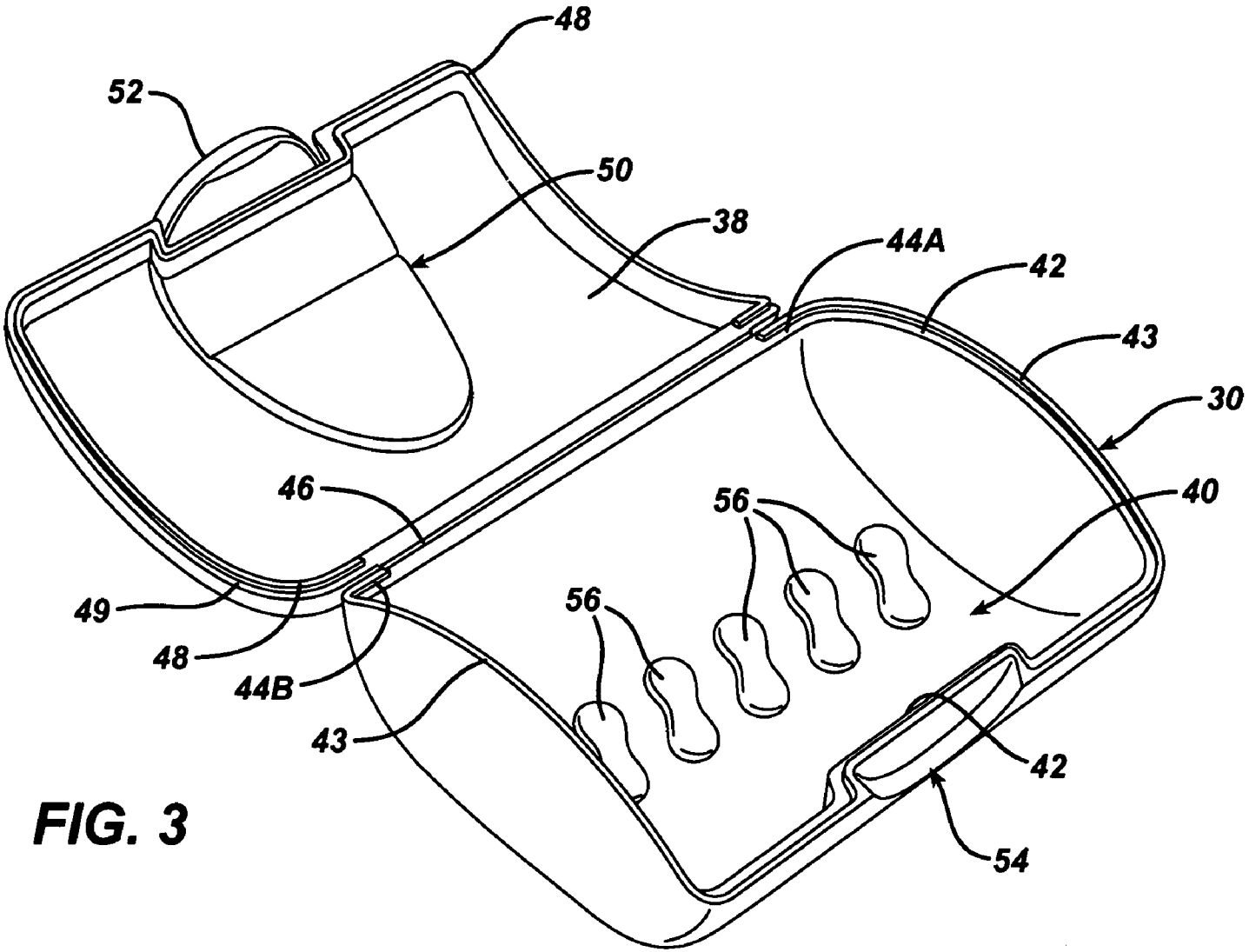
FIG. 3 depicts the embodiment of FIG. 2 with the soap item removed.

FIGS. 2 and 3 depict the soap dish container 30 with a soap bar present or without, respectively. A container includes a top portion 38 and a bottom portion 40. The bottom portion of the container is the area where a particular accessory, here a soap bar, is received before the case is closed.

Again, the following discussion is illustrative of all the cases depicted herein. The features specific to a particular application will be discussed in conjunction with that particular embodiment.

The bottom 40 includes a groove portion 42 defined by an upwardly extending perimeter wall 43. This groove in the embodiment shown, extends on three sides of the bottom portion of the container and minor portions 44A and 44B extending partially along the edge 46 common with the top portion 38 of the container. Although depicted as extending slightly along that common edge 46, the upwardly extending member 43 can likewise be molded to extend the full length of edge 46 so as to provide for a continuous groove, 42, along the entire four sides of the bottom portion of the container.

The top portion 38, is molded so as to include a raised portion 48 which complements the grooved portions 42, 44A and 44B of the bottom portion. Of course if groove 42 extends entirely around the four sides raised portion 48 would similarly be extended to complement the groove along the edge 46. The raised portion 48 similarly defines a groove portion 49 which complements raised portion 43 of the bottom part of the container. The complementing segments of the top and bottom portion result in a tight and generally sealed closure between the top and bottom portions of the case. This is helpful to trap bothersome soap odors, for example, that might emanate from the case and/or liquid, such as water, that might come to be present therein during the case's usage.

The top portion 38 includes a molded recess 50, more apparent in subsequent figures, to accept a latch member 52.

The bottom portion 40 includes a molded recess 54, which is configured to accept an engagement portion of the latch member 52, again, better seen in the drawings described hereinafter.

Along edge 46, the product is molded so as to include a hinge member, once again better seen in subsequent drawings, which is formed, during the molding process, with certain beneficial characteristics to be discussed hereinafter.

In the specific soap dish application depicted in FIG. 3, there are molded into the bottom portion 40 of the container raised portions 56. These support the soap above the bottom surface of the bottom portion of the container so as to minimize the adherence of the soap bar, particularly when wet, to that bottom surface. This minimizes the accumulation of soap scum and facilitates the removal of the bar when necessary.

The top and bottom portions of any container are contoured to provide an aesthetic appearance, as well as to define an interior volume suitable, of course, to handle appropriately sized articles, as would typically be brought on a trip.

Figure 4:
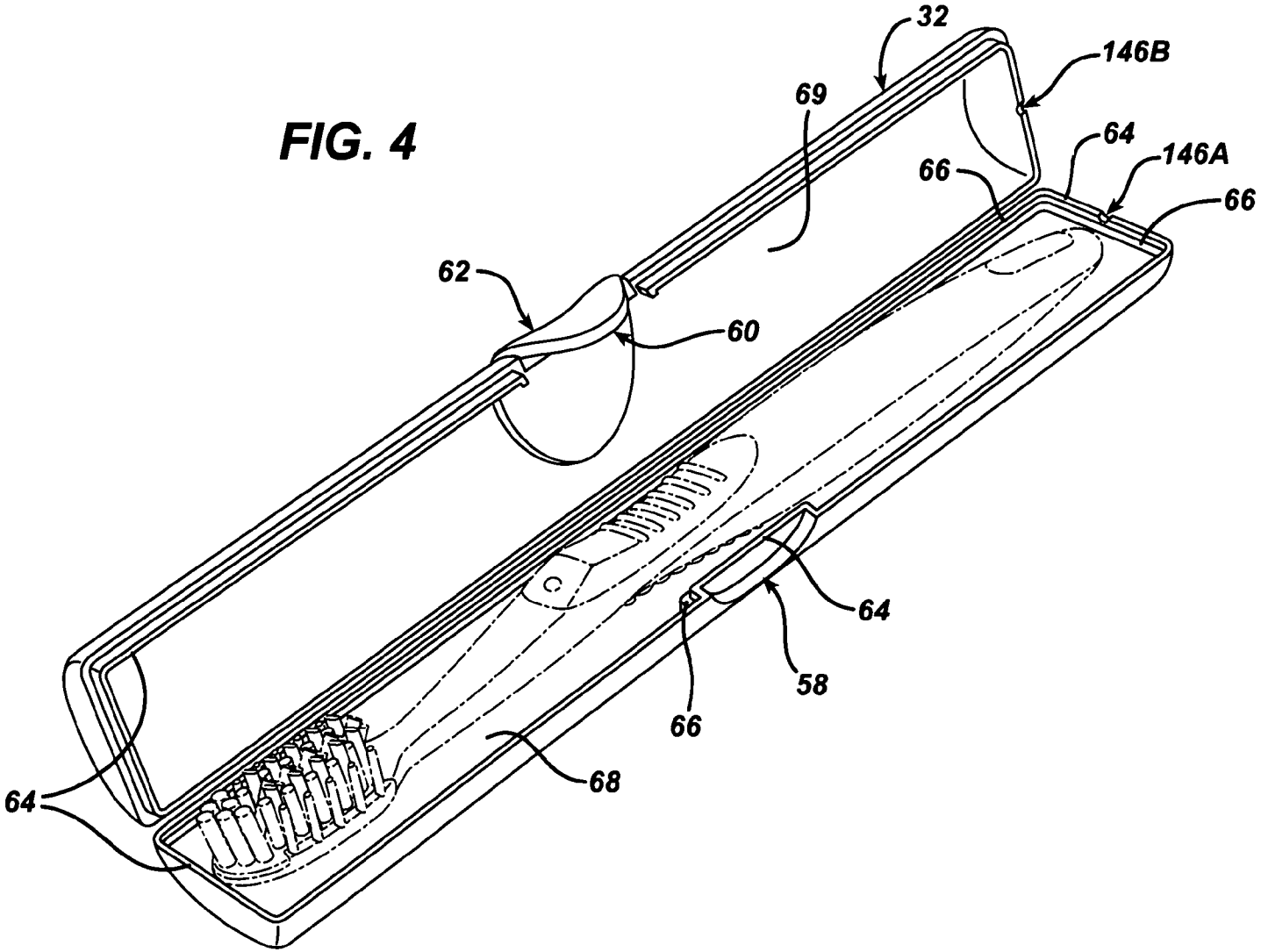
FIG. 4 is a perspective view of a second one of the grouping of FIG. 1 which is useful as a tooth brush container.

FIG. 4 depicts a tooth brush holder embodiment of the present container configuration. The tooth brush holding container 32 includes a molded recess 58 essentially identical to the recess 54 for the soap dish. Recess engaging portion 60 of the latch member 62 engages this recess 58 when the container is closed. Upwardly extending portion 64 extends around the perimeter of the lower portion 68 of the tooth brush holder to form a groove 66. A complementing raised portion and groove in the top portion 69 of the container nests with portion 64 and groove 66 to, again, provide a relatively tight seal between the upper and lower portions of the container.

Figure 5:
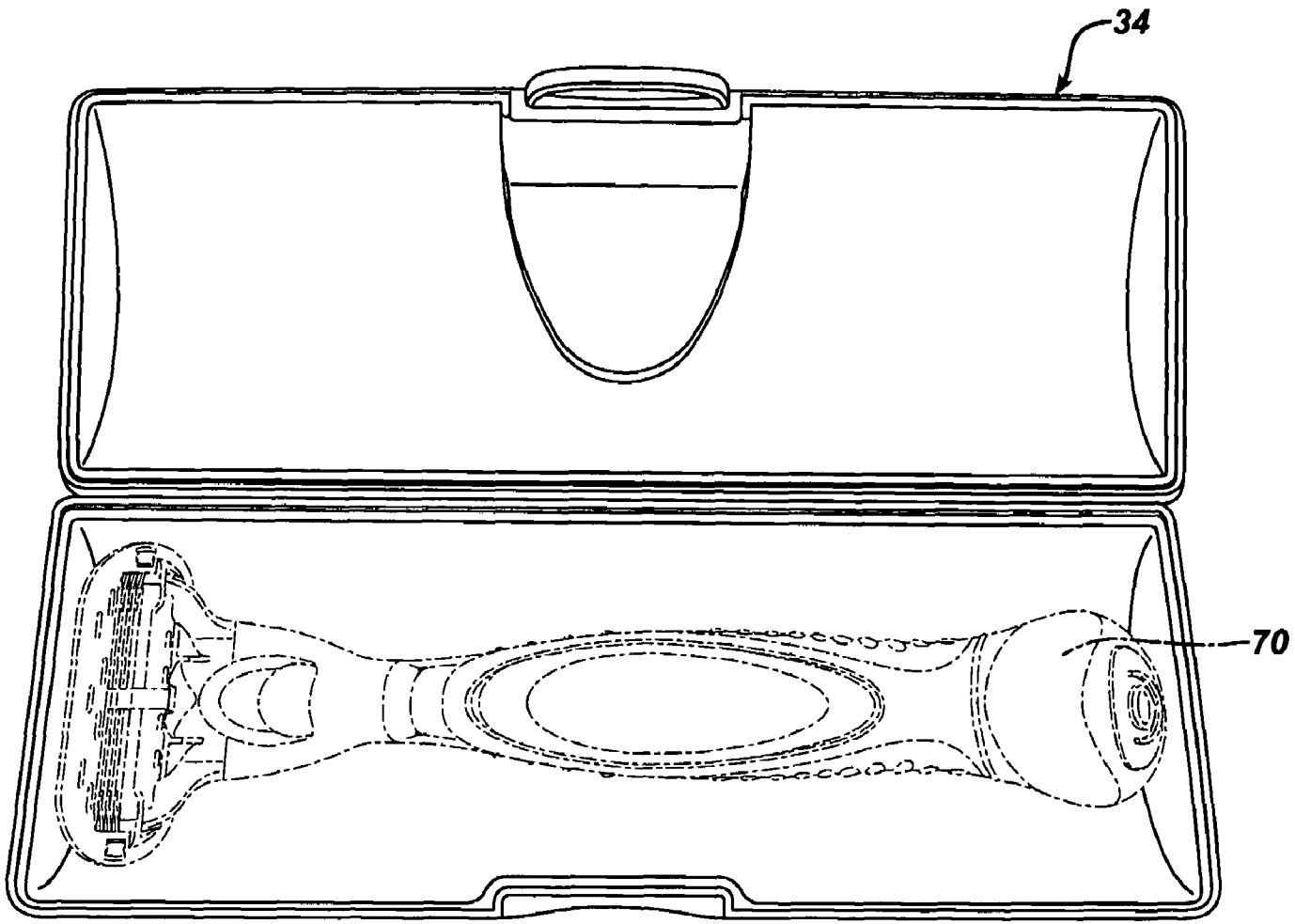
FIGS. 5, 6 and 7, are perspective views of yet another one of the groupings of containers showing its usefulness for carrying a varied assortment of personal care items.
Figure 6:
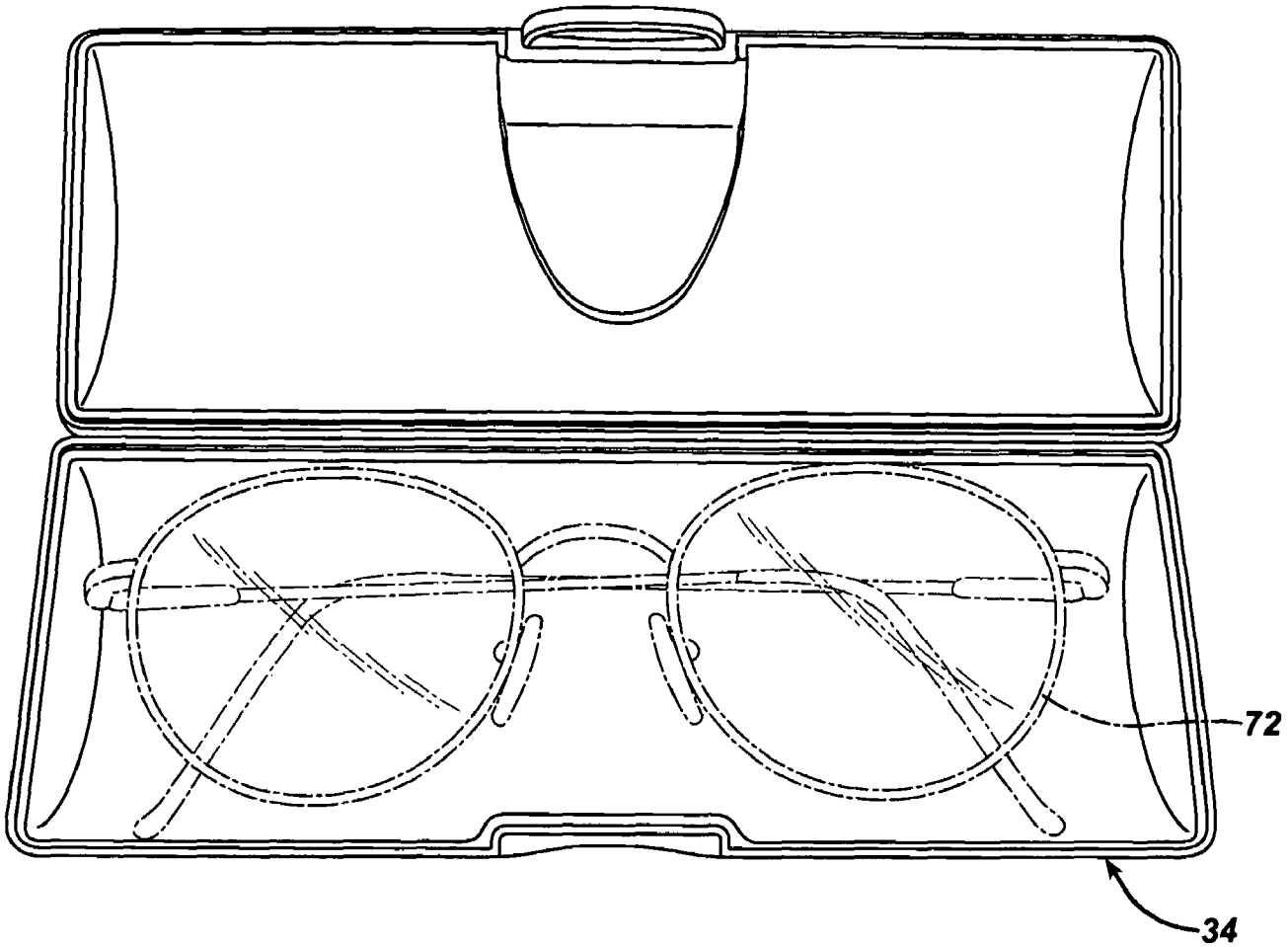
Figure 7:
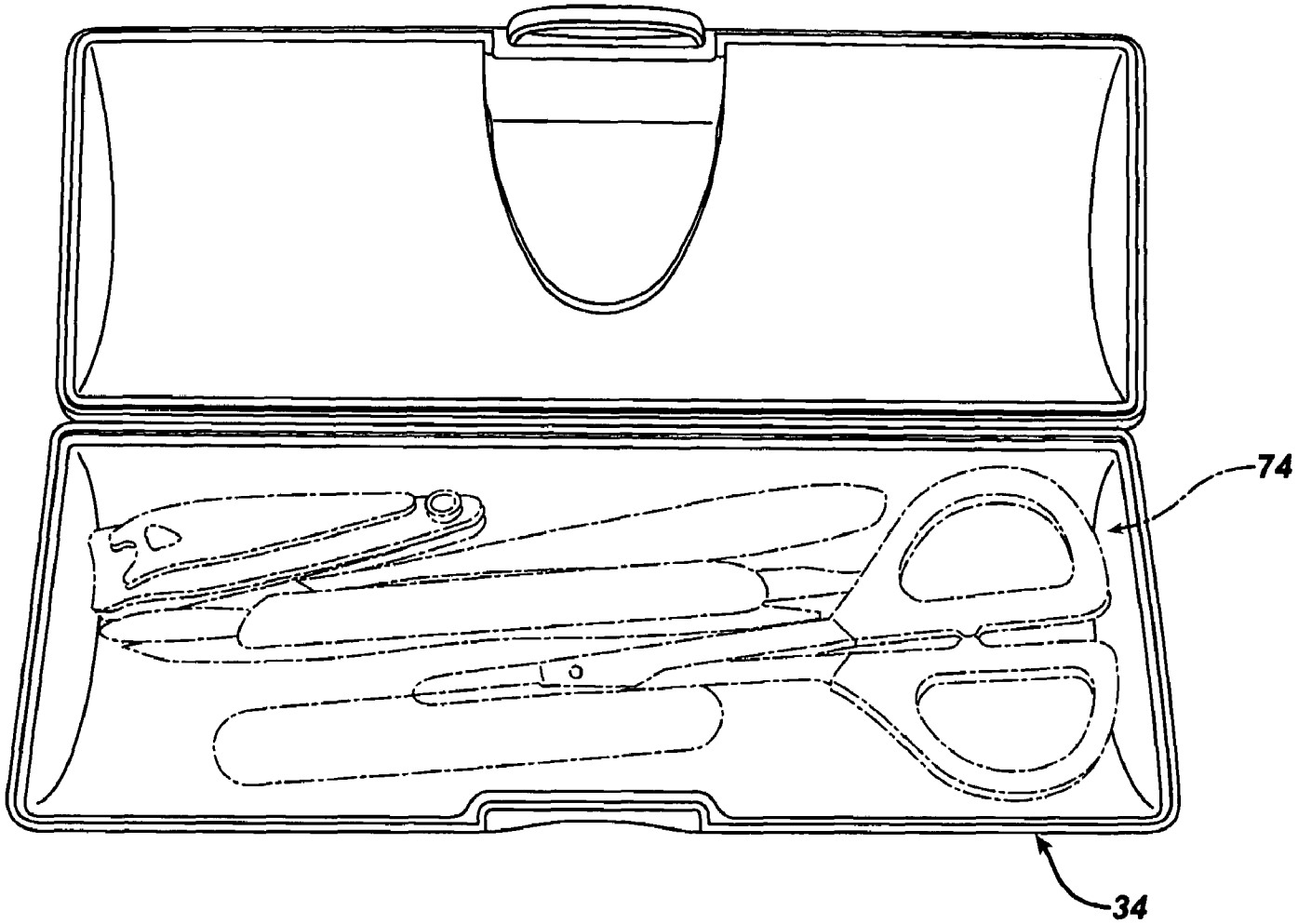

In FIGS. 5, 6 and 7, the personal accessory case of the proposed invention is shown with various items stored therein, including a razor 70, eyeglasses 72 or various personal hygienic items 74, including nail clippers, tweezers, scissors, nail file, cuticle tool, etc. This version has identical features to the earlier described embodiments except the raised portion 56 of the soap dish.

Figure 8:
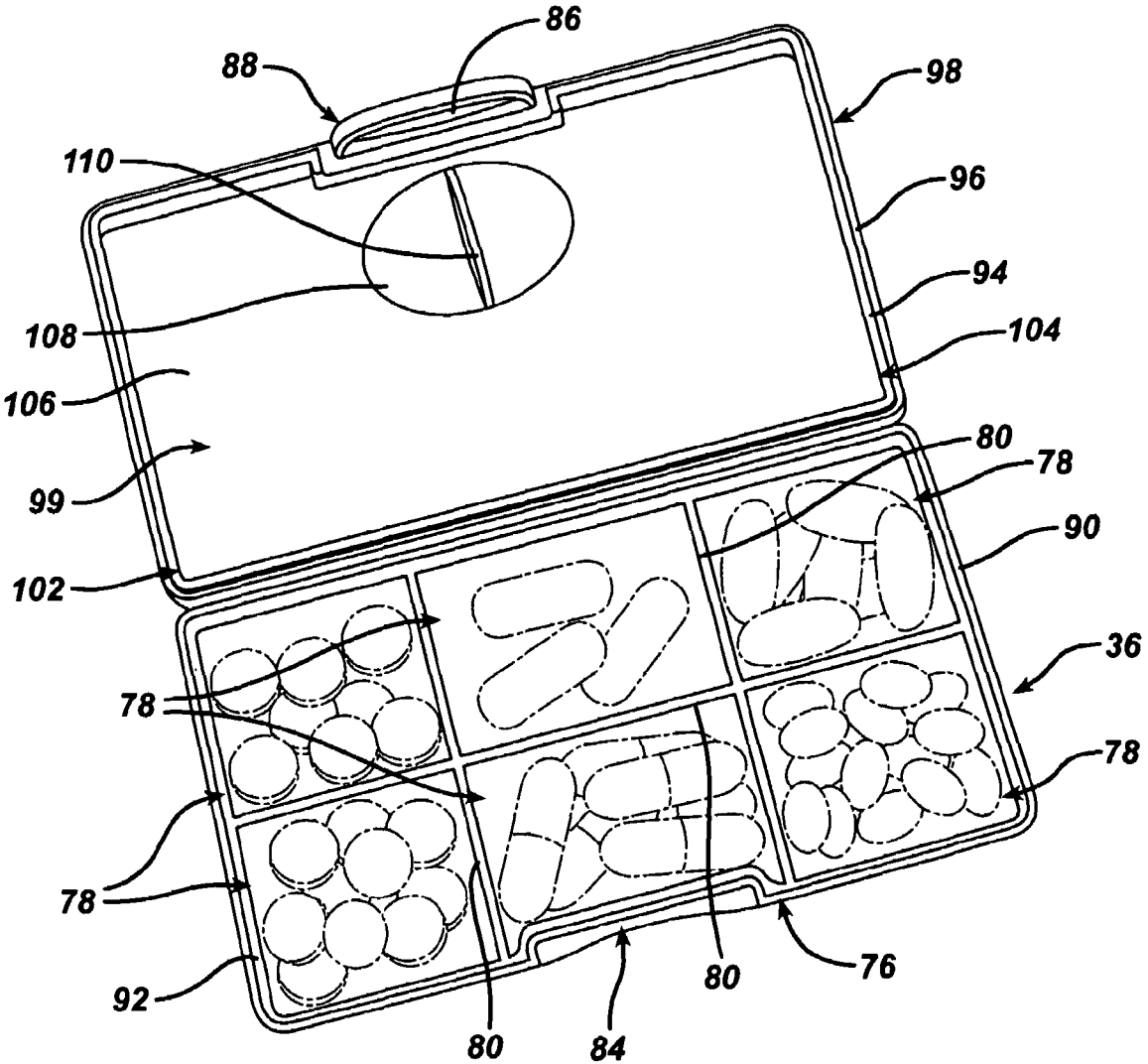
FIGS. 8, 9 and 10 depict in respective perspective views, yet another of the grouping of personal care containers shown in FIG. 1, which is useful as presently contemplated as a medicine or jewelry carrier and including a further feature of the present invention.
Figure 9:
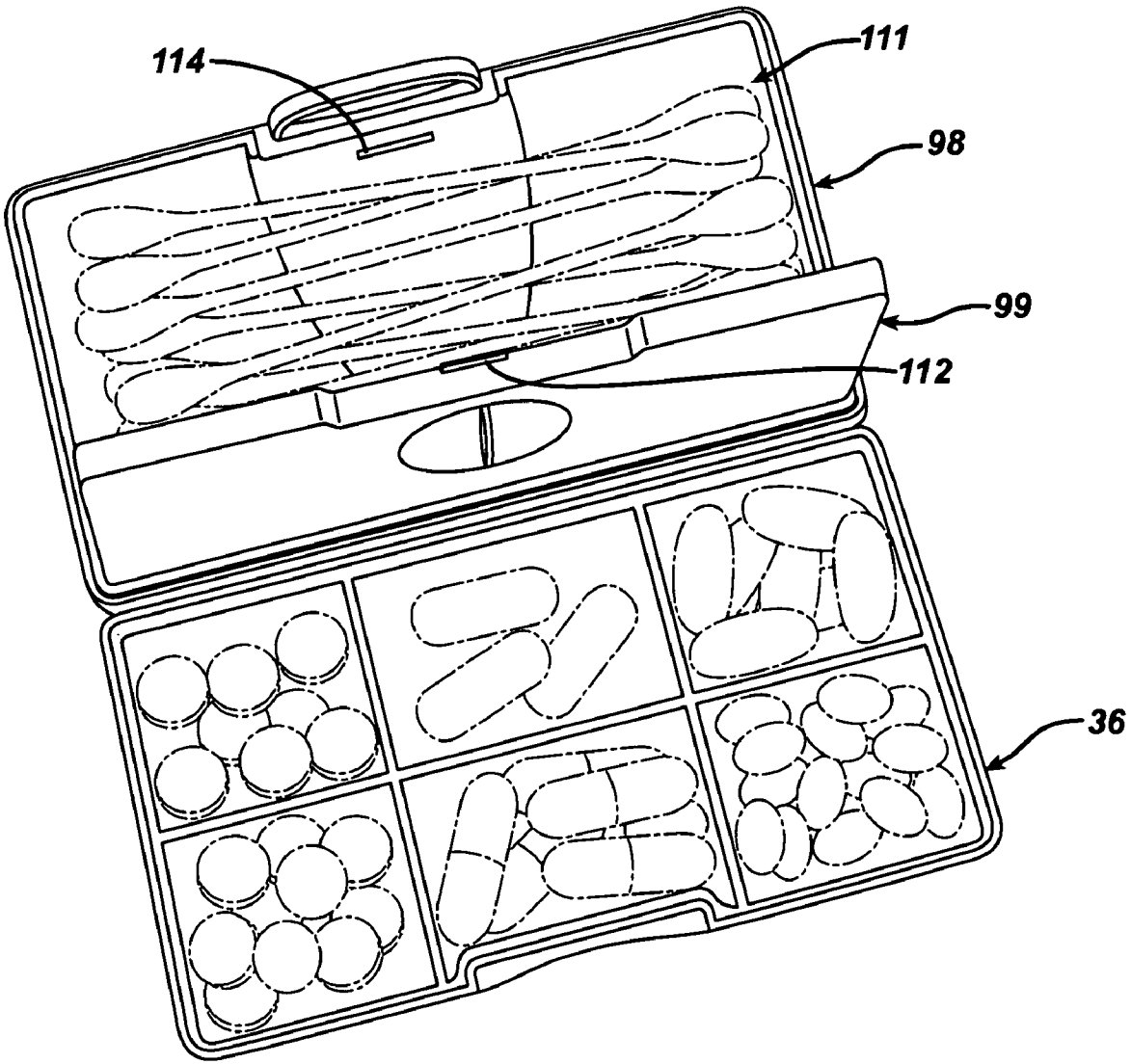
Figure 10:
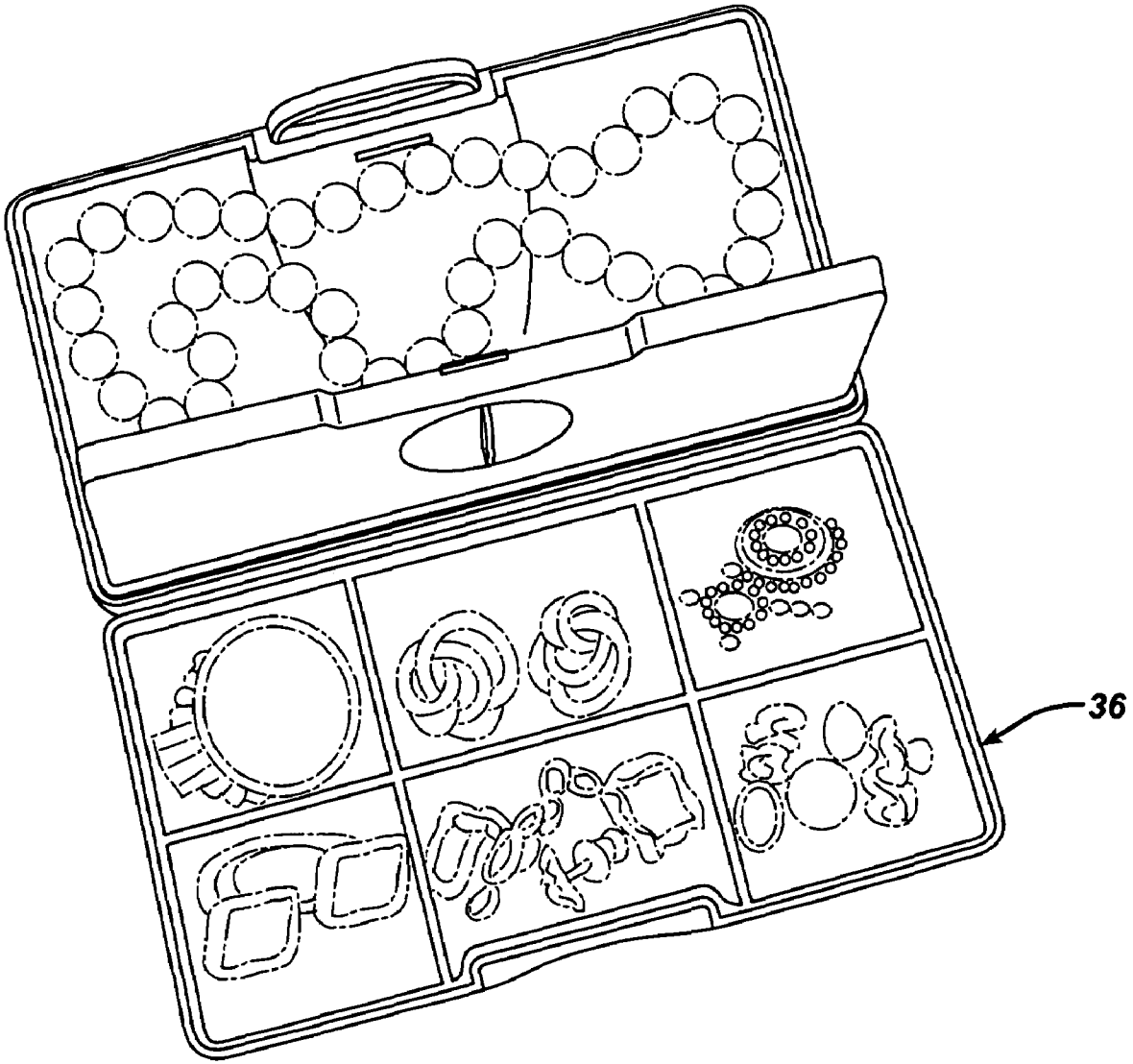

FIGS. 8, 9 and 10 depict still another version of the improved case of the present invention. For purposes of discussion the case may be referred to as a pill case or a jewel case, although, obviously, these terms are not to be construed as limiting in terms of its possible applications.

In this adaptation of the basic case of the invention, bottom portion 76 includes a plurality of smaller compartments 78. These compartments are defined by partition members such as 80 molded into the product so as to extend upward from the interior side (not readily seen) of the bottom portion 76. The smaller compartments 78 are shown for illustration purposes as squarely configured. Obviously the molded shape can be as varied as desired with the compartments being identically configured or not.

The bottom portion 76 includes a molded recess 84 which engages portion 86 of latch member 88.

Upwardly extending perimeter member 90 extends around the circumference of the bottom portion to form a groove 92. As above, these complement corresponding perimeter and groove portions 94 and 96 in the top portion 98 of the container.

In this embodiment, a closure or separator member 99 is separately molded and during assembly engages the top portion 98 at pivot recesses 102 and 104. Molded into the surface 106 is a finger recess 108 and extension 108, configured so as to be suitable for gripping by one's fingers. This enables the user to lift the separating member 99 from its retentive engagement with the top portion 98 when it is desirable to access the compartment 111 disposed between the separating member 99 and the interior surface of the top portion of the case, 98. The separating member 99 is also important to seal the compartments 78 so that the medicines or other items contained therein, are retained during transit.

Again, FIG. 10 depicts the embodiment described in FIGS. 8 and 9 wherein the user places various items of jewelry in the container to insure safe storage.

The discussion of FIGS. 11 through 18C although related to a particular case style, will be seen to have general application to the various case embodiments described above. The focus of the present discussion is directed to the configuration of the latch member and case and its engagement therewith; the technique with opening and closing the case, and, the formed, molded hinge which interconnects the top and bottom portions of the case.

Figure 11:
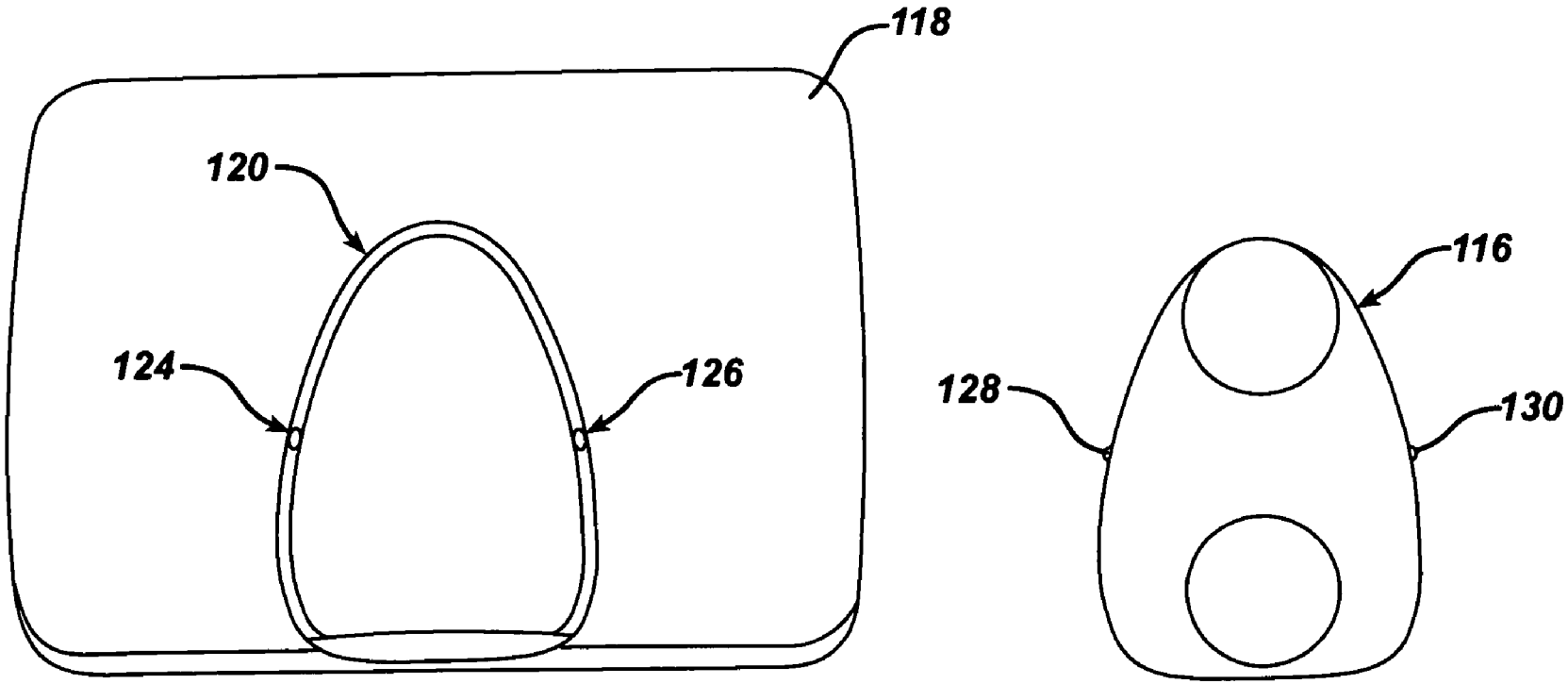
FIG. 11 is a depiction of the top cover portion of the container of the present invention with the latch member removed.
Figure 12:
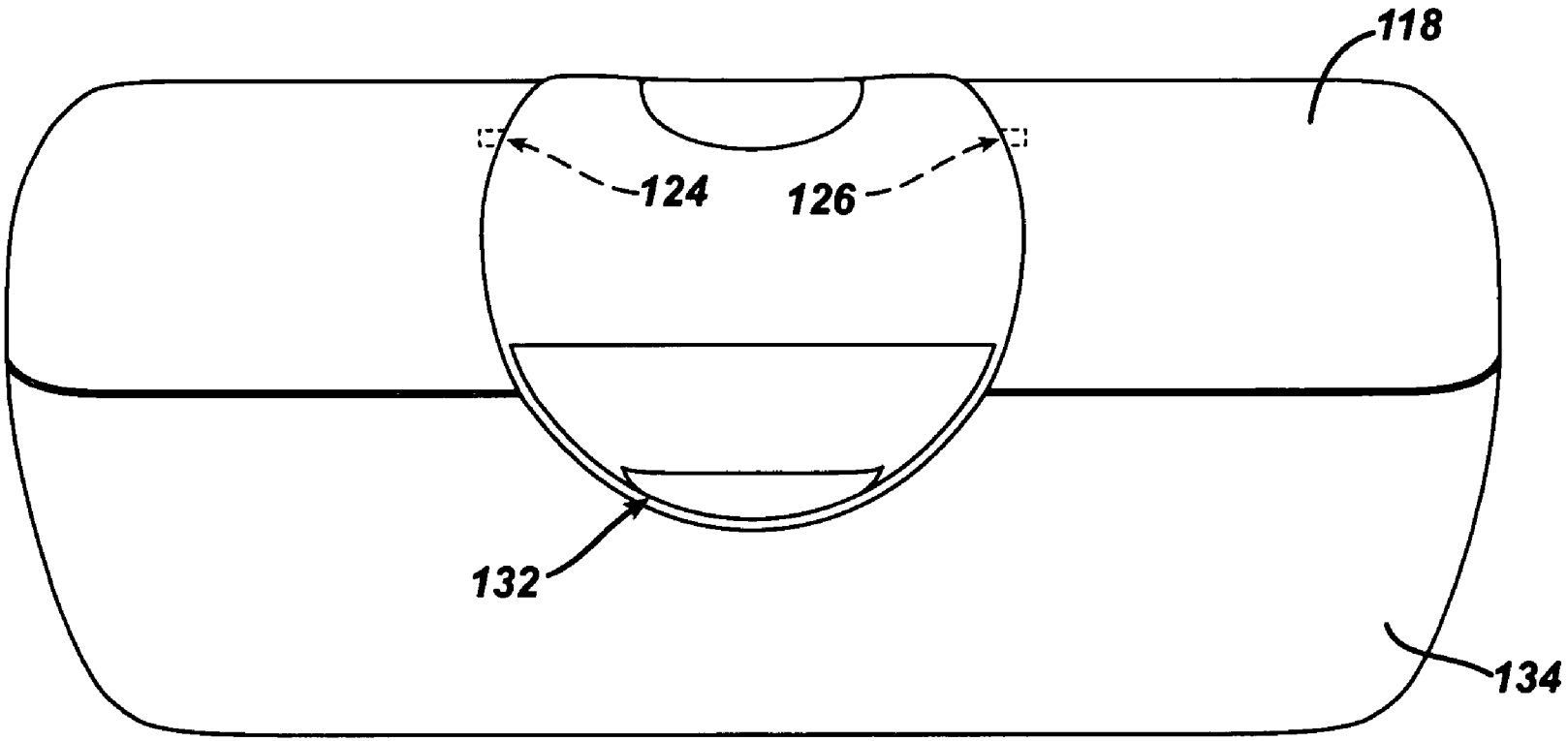
FIG. 12 is a front elevation view of one of the containers of FIG. 1 showing the notched area in the top container portion as well as the latching groove in the bottom container portion, which engage the latch portion of the present invention.

FIG. 11 depicts the latch member 116 separated from the top portion 118 of the case. The top portion 118 includes a molded recess 120, dimensionally configured to the shape and dimensions of the latch member 116. When the latch member 116 is assembled to the top portion of the case, its top surface 117 (FIG. 17C) forms a smooth contour 121 (FIG. 17A) with the upper surface 122 of the case results when the case is latched. Recess 120 includes a pair of surface depressions 124 and 126. These are positioned so as to engage protrusions 128 and 130 formed in the latch member 116 when the latter is molded. The latch member is joined to the top portion 118 by first inserting one of the protrusions, for example 128, in its corresponding depression and then manipulating the latch member piece, bowing it to some extent, to allow the second protrusion, for example 130, to engage its corresponding surface depression 126. Depressions 124 and 126 in appearance are much like the surface depressions on a golf ball albeit, perhaps, slightly deeper.

Figure 17A:
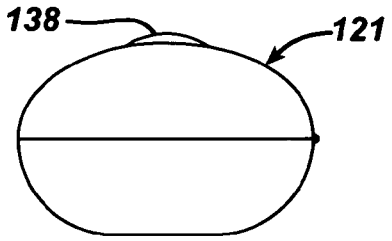
FIGS. 17A and 17B are a side elevation view and top plan view respectively of one of the embodiments depicted in FIG. 1, shown with the latch closed.
Figure 17B:
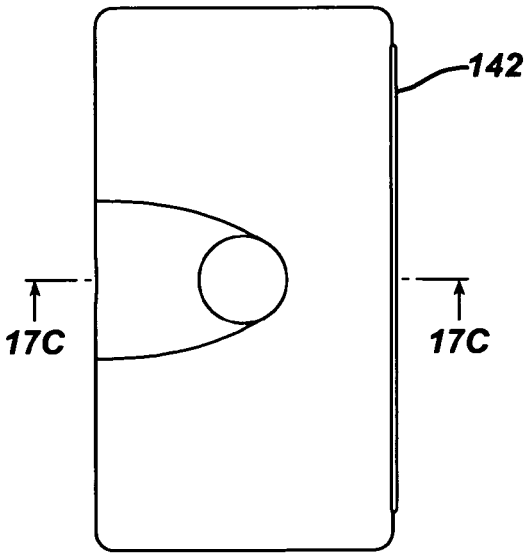
Figure 17C:
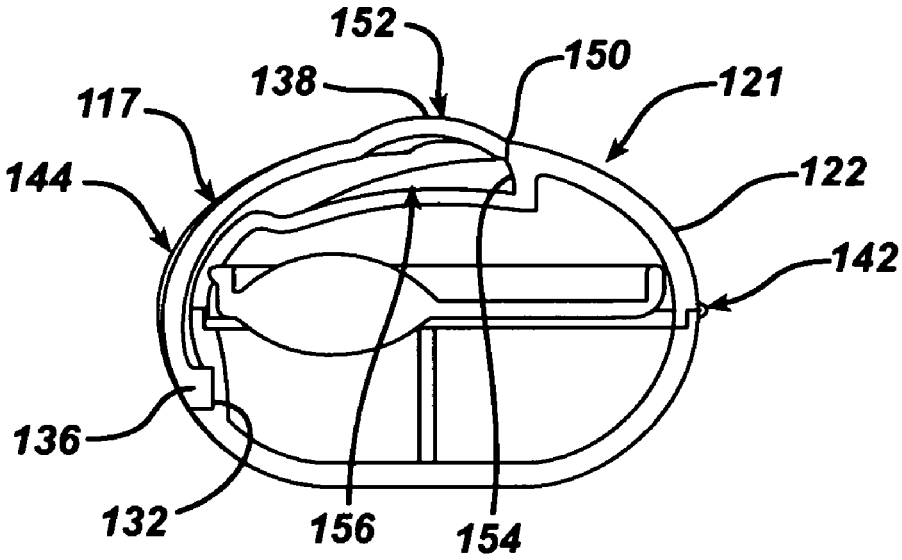
FIG. 17C, is a sectional view along lines 17C-17C of FIG. 17B, depicting the relationship of the container and latch member when the latch is closed.
Figure 18C:
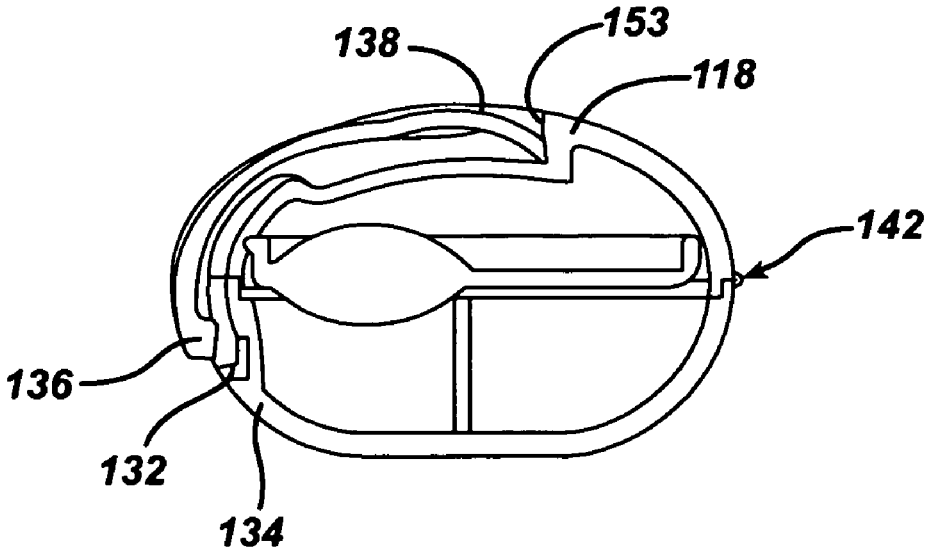
FIG. 18C is a cross-sectional view taken along lines 18C-18C of FIG. 18B, showing the latch member of the present invention disengaged from the bottom container portion when the latch has been opened.

In FIG. 12, and again in FIG. 18C, a latch member engaging recess 132 is seen in the bottom portion 134 of the case. This recess will engage protrusion 136 of latch member 116 (best seen in FIG. 17C) when the case is closed.

Figure 13:
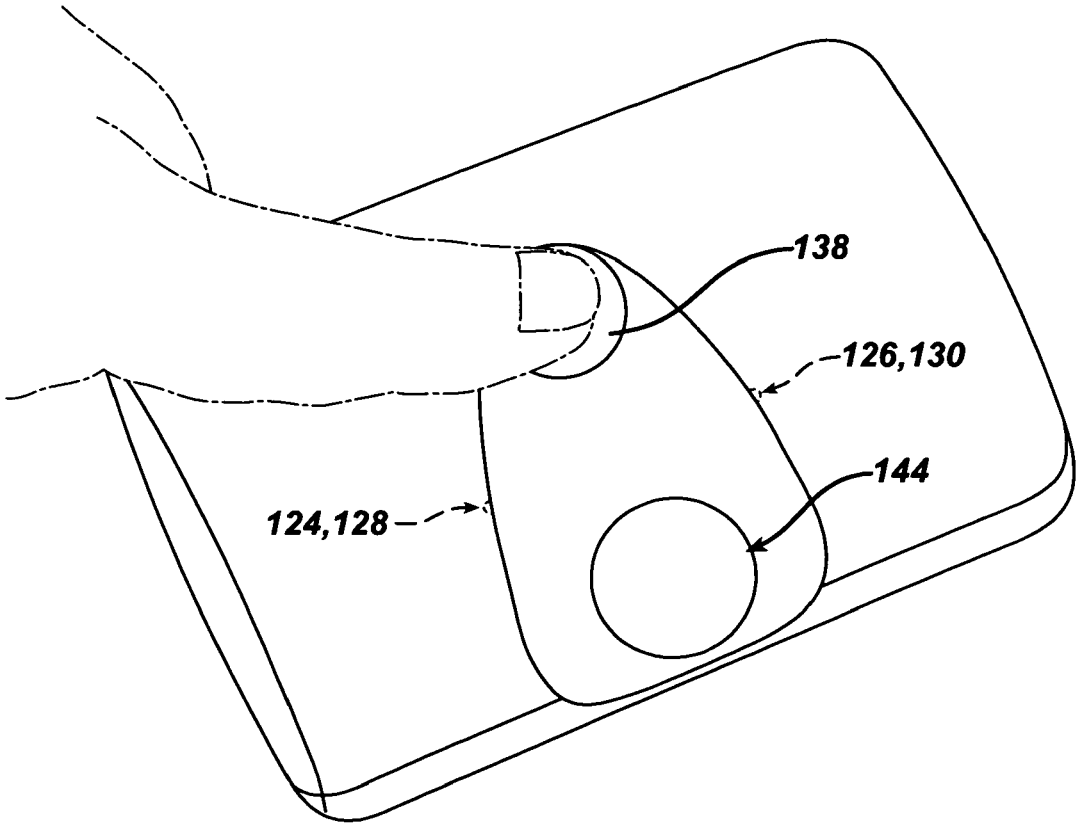
FIGS. 13 and 14 illustrate the un-latching aspect of the present invention.
Figure 14:
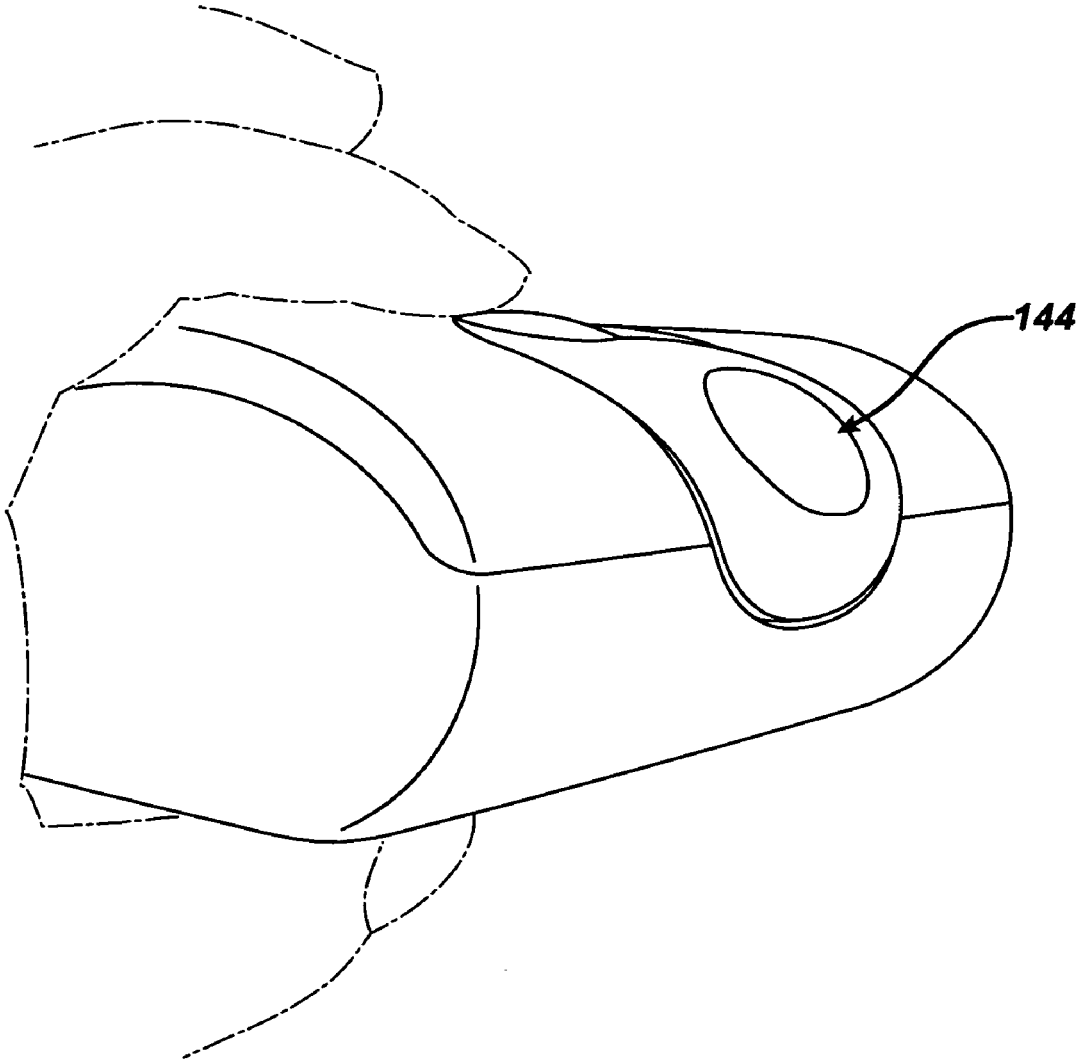
Figure 15:
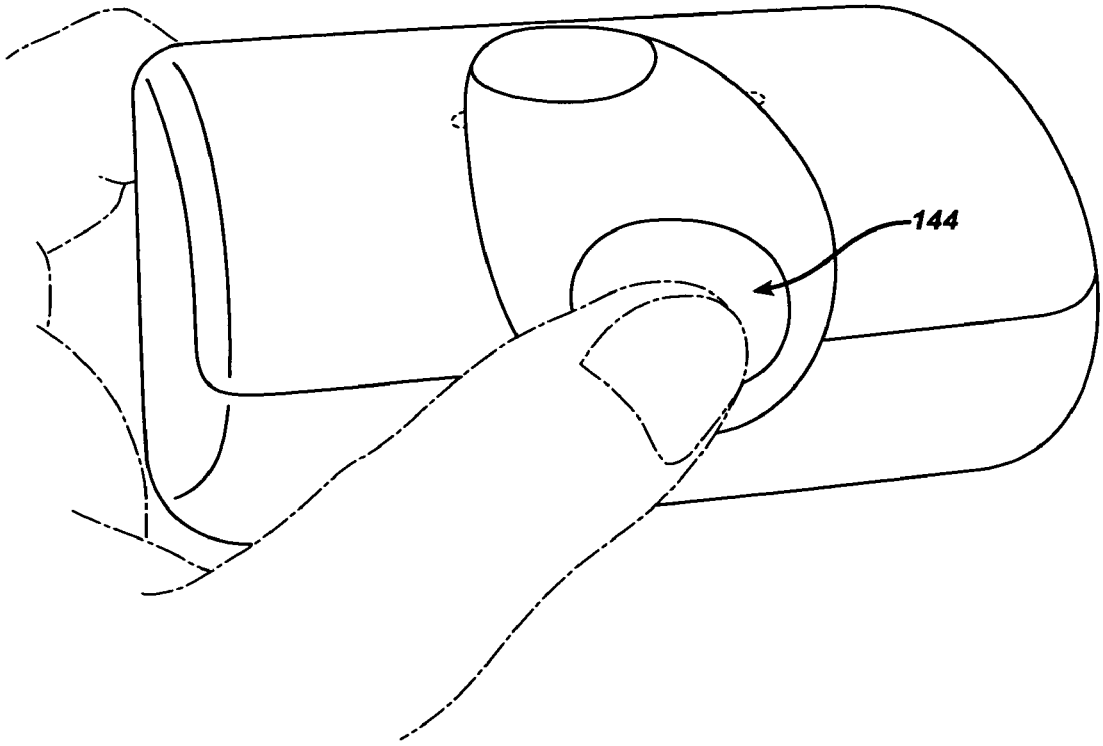
FIG. 15 depicts the latching operation to close and secure a container in accordance with the principles of the present invention.
Figure 16:
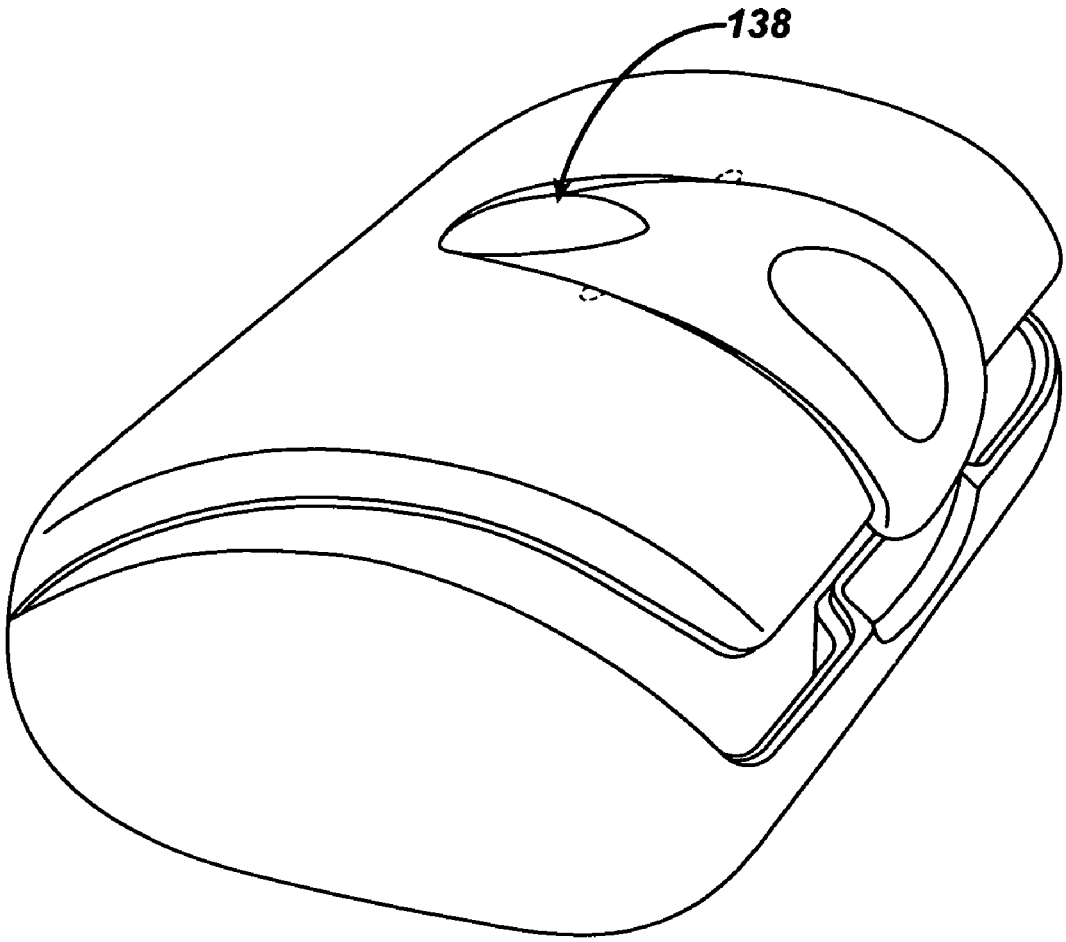
FIG. 16 is a perspective side view of one container in accordance with the principles of the present invention, which illustrate the consequence of the living hinge feature of the present invention.
Figure 18A:
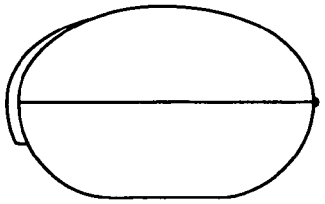
FIGS. 18*a* and 18B are a side elevation and top plan view of the same container of FIGS. 17A, 17B and 17C, now shown when the latch portion of the invention has been opened.
Figure 18B:
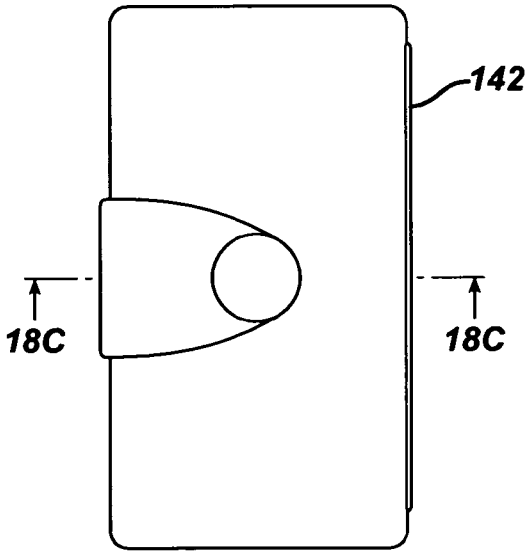

FIG. 13 illustrates the procedure for opening the case when it is latched closed. The operator engages a raised portion 138 of the latch member 116 and pushes it inward. This causes the latch member 116 to pivot about points 124, 128 and 126, 130, resulting in the disengagement of protrusion 136 from recess 132 and thus freeing the top portion 118 from the bottom portion 134. If the operator then removes his finger from the raised portion 138, the top portion will move away, slightly, from the bottom portion because of the bias inherent in the plastic hinge 142 formed between the top portion 118 and the bottom portion 134 during the molding process. This allows for the operator to easily open the case fully to allow access to the items within.

When it is time to close the case, the operator would bring the top portion 118 and the lower portion 134 together and apply finger pressure to point 144 on the latch member. Point 144 is disposed on the opposite side of the pivot 124, 128, 126, and 130, from the raised portion 138. With the top and lower portions brought tightly together, by depressing the latch member at the point 144, protrusion 136 reengages the recess 132 to once again establish a secure closure.

Although the protrusion 138 and location 144 are depicted as a raised and recessed segments, this only facilitates the opening of the container due to their respective locations on either side of the pivot point. This enables the user through a sense of touch alone to locate the appropriate point the operator must engage in order to get an open or close the container. It is to be understood that just applying finger pressure on either side of the pivot point in accordance with the above description, would be sufficient to open or close the case.

As noted above, the top portion and the bottom portion of the container are formed during an injection molding process employing polypropylene plastic material. Generally, for the various embodiments, the wall thickness of the top and bottom portions is typically in the range of 0.090 inches to 0.125 inches, although, obviously, other wall thicknesses can be employed. At the juncture between the upper portion and lower portion is the hinge member 142 which is approximately 0.01 inches at its thinnest point, furthest removed from the case, increasing in thickness to approximately 0.03 inches at its juncture with the respective upper and lower portions of the case. This thickness variation provides a bias which allows for the top portion to move away from the lower portion once the latch is opened thus providing easy access to the interior of the case. The latch member and the separator member for the pill case application are separately molded and the parts assembled to the upper case portion during the case assembly.

For purposes of display, the individual items can be held separately on a display rack using hang tags for each individual item. These can be secured to the individual case member by notching the upwardly extending perimeter portions such as 64 and its complementing segment in the top cover, to allow the hanging tag to be retained by the particular case when it is in its secured, closed position. Such a notch is shown at 146A and 146B in FIG. 4.

A further feature of the present invention is depicted in FIGS. 17C and 18C. It relies on the interaction of end 150 of latch member, for example 152, and the indented segment 154 molded into the molded recess area 156.

When the operator presses the raised portion 138, downward, end 150 is first met with resistance from the juxtaposed portion 153 of the recess area 156. When the end portion 150 reaches the indented segment 154, the compression of the latch member is relieved. A similar effect, but in reverse, occurs when the recessed segment such as point 144 is pressed by the operator to reengage protrusion 136 and recess 132.

Either activity results in an audible click. Apparently this is a desirable effect which enhances the marketability of the container.

Other embodiments and variations to the above described configurations will be apparent to those with skill in this area and the breadth of the invention is not to be construed as limited by the disclosed embodiments.

What is claimed:

1. A molded container comprising:

(a) a top portion having a front and rear edge;

(b) a bottom portion having a front and rear edge;

said front and rear edges of the top and bottom portions coextensive with each other when said container is a closed position;

(c) a hinge portion of predetermined thickness, said hinge portion connecting together at least a portion of said coextensive rear edges of said top and bottom portions;

(d) a latch mechanism including an arcuately shaped latch member having a rearward portion and a front portion and including pivot means and a latch engagement portion;

each of said top and bottom portions having a respective partially arcuately shaped section beginning at said respective front edge and extending back towards said respective rear edge;

each of said top and bottom portions including a respective molded recess area formed in said respective partially arcuately shaped section, said molded recess areas extending from said front edge of said respective top and bottom portions back towards said respective rear edges, said molded recess area of said top portion including molded complementing pivot means for providing a pivotal connection when engaged by said pivot means of said latch member, said molded recess area of said bottom portion including a molded contoured segment of predetermined design so as to engage said latch engagement portion of said latch member when the front edge of said top portion is brought contiguous to said front edge of said bottom portion and an operator applies pressure to a portion of said latch member disposed between said pivotal connection and said front edge;

said latch engagement portion disengaged from said molded contoured segment when an operator applies pressure to a second portion of said latch member disposed between said pivotal connection and said rear edge of said top portion;

said latch member dimensioned and contoured to nest in said molded recess area at assembly said latch member including a top surface which is contoured so as to provide a continuous smooth surface with the respective partially arcuately shaped section of said top portion.

2. The molded container claimed in claim 1 wherein said top and bottom portions and said hinge portion are molded together from a predetermined type of plastic to form an integral one-piece unit.

3. The molded container claimed in either claim 1 or claim 2 wherein the top surface of the latch member includes at least one surface anomaly selected from the group consisting of a depression or a raised portion, disposed on said top surface between said pivotal connection and said rear edge of said top portion, the surface anomaly intended to facilitate the locating of a point on the top surface where the operator can apply pressure so as to disengage the latch engagement portion from said molded contoured segment.

4. The molded container claimed in claim 3 wherein the top surface of the latch member includes a surface anomaly selected from the group consisting of a depression or a raised portion, other than the one selected in claim 2, disposed on said top surface between said pivotal connection and said front edge of said top portion wherein the surface anomaly disposed on said top surface between said pivotal connection and said front edge of said top portion is intended to facilitate the locating of a point on the top surface where the operator can apply pressure so as to engage the latch engagement portion and said molded contoured segment when it is desired to close the container.

5. The molded container claimed in either claim 1 or claim 2 wherein said hinge portion is adapted to have an inherent bias such that when said latch engagement portion is disengaged from said molded contoured segment, the inherent bias moves the top portion away from the bottom portion.

6. The molded container claimed in either claim 1 or claim 2 wherein the bottom portion includes an interior surface, said interior surface including a plurality of raised portions interior to the bottom portion which are arranged and adapted so as to support any contents within the container off from said interior surface.

7. The molded container claimed in either claim 1 or claim 2 further comprising a separator member pivotally connected to a portion of the interior surface of the container, said separator member adapted to provide at least two separate compartments interior to the container each of said at least two separate compartments having a respective volume, said separator member adapted to include means for securing the separator member to one or the other of the top or bottom portions to thereby form said at least two separate compartments, said separator member further adapted to include means for disengaging said separator member from one or the other of the top or bottom portions to thereby permit access to contents contained in one of said at least two separate compartments.

8. The molded container claimed in claim 7 wherein the respective volume of at least one of said at least two compartments is subdivided into a plurality of smaller volumes by a corresponding number of partition members.

9. The molded container claimed in either claim 1 or claim 2 wherein said rearward portion of said latch member includes an end segment and wherein said molded recess area of said top portion includes an end surface and indented segment juxtaposed to said end segment of said latch member when the pivot means of said latch member are pivotally connected to said molded complementing pivot means of said molded recess area of said top portion, whereby the movement of the end segment past the end surface into the indented segment and the movement of the end segment out of the indented segment in response to the operator's applied pressure to the second portion and first portion, respectively, results in an audible click.

10. The molded container claimed in claim 9 wherein said hinge portion is adapted to have an inherent bias such that when said latch engagement portion is disengaged from said molded contoured segment, the inherent bias moves the top portion away from the bottom portion.

11. A group of at least two molded containers as claimed in claim 10 wherein each one of the containers has respective length, height and width dimensions and wherein at least one of said length, height and width dimensions is different from the length, height and width dimensions of a second one of said at least two molded containers.

12. The group of containers claimed in claim 11 wherein there are at least four such containers and wherein each said container has a different length than any other one of said at least four such containers.

13. A group of at least two molded containers as claimed in claim 5 wherein each one of the containers has respective length, height and width dimensions and wherein at least one of said length, height and width dimensions is different from the length, height and width dimensions of a second one of said at least two molded containers.

14. The group of containers claimed in claim 13 wherein there are at least four such containers and wherein each said container has a different length than any other one of said at least four such containers.

* * * * *